US010984680B1

(12) United States Patent
Bowen et al.

(10) Patent No.: US 10,984,680 B1
(45) Date of Patent: Apr. 20, 2021

(54) GREETING CARD LEVER AND SPIRAL LIFT

(71) Applicant: HALLMARK CARDS, INCORPORATED, Kansas City, MO (US)

(72) Inventors: Douglas M. Bowen, Russellville, AR (US); Robert R. Pavlu, Jr., Overland Park, KS (US); Thomas A. Wallen, Merriam, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 16/802,003

(22) Filed: Feb. 26, 2020

(51) Int. Cl.
*G09F 1/06* (2006.01)
*A63H 33/38* (2006.01)

(52) U.S. Cl.
CPC ..... *G09F 1/06* (2013.01); *A63H 33/38* (2013.01)

(58) Field of Classification Search
CPC .. G09F 1/06; G09F 1/08; A63H 33/08; A63H 33/38; B42D 15/04; B42D 15/042
See application file for complete search history.

(56) References Cited

U.S. PATENT DOCUMENTS 2,749,657 A * 6/1956 Lohnes ..... B42D 15/045 446/150
3,418,748 A * 12/1968 Margolis ..... B42D 15/045 446/150
7,325,341 B2 * 2/2008 Mouyal ..... G09F 1/00 40/124.01
7,637,044 B2 * 12/2009 Hluchan ..... G09F 11/23 40/124.01
9,830,836 B1 * 11/2017 Bowen ..... B42D 15/042
2006/0096138 A1 * 5/2006 Clegg ..... G09F 1/06 40/124.08

* cited by examiner

*Primary Examiner* — Cassandra Davis
(74) *Attorney, Agent, or Firm* — Shook, Hardy & Bacon L.L.P.

(57) ABSTRACT

A greeting card assembly with a card body panel, a cam lift mechanism, and at least one decorative element fixed to tab portions of the cam lift mechanism extending through cam slots in the card body panel. The cam lift mechanism is actuatable by pivoting subpanels of the card body panel away from each other. Pivoting of one of the subpanels causes lateral movement of a cam lever, which then pulls an extended arm portion of a rotating portion of the cam lift mechanism, causing the rotating portion to rotate about a primary axle. The cam slots guide the decorative elements radially outward or radially inward toward the primary axle upon rotation of the cam lift mechanism, causing the decorative elements to pop up or extend outward from the card body panel.

20 Claims, 12 Drawing Sheets

GREETING CARD LEVER AND SPIRAL LIFT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The present invention is related to amusement devices, and more particularly, may be embodied as a greeting card product utilizing paper mechanics as a primary form of attraction.

Over the years, designers have utilized a wide variety of features to make greeting cards and related gift items more attractive and desirable to consumers. In addition to the use of various colors, pictures, designs and phrases, cards have also been designed with selectively moveable portions in an effort to draw attention to the card. A popular means for incorporating some form of motion into a greeting card is to employ paper mechanics technology with the moving items being located inside the card. The particular arrangement of folds in the paper or cardstock inside the card make it such that the motion is generally caused by the opening and closing of the card, creating what is commonly referred to as a "pop-up" effect. While paper mechanics technology is well known and can provide for various types of movement, this method of imparting movement in the card is generally limited to linear up and down or side-to-side motion within the interior of a card. For example, by moving the card from a folded to an unfolded position, this motion extends opposite ends of a planar paper layer away from each other causing a central portion of the paper to pivot outward and upward from the card as the card opens. Alternatively, a tab fixed to a movable paper item on a right side of the card is pulled leftward as the card opens. Although current paper mechanics provide for pivoting from a bottom of the card to a top of the card or sliding from a right side to a left side of the card, they do not provide for more complex motions without additional electrical or non-paper mechanical mechanisms. For example, a small electric motor may be placed within the card, but this solution can be bulky, more expensive, and make undesireable noise compared with paper mechanics solutions. Therefore, it is desirable to provide a different method of imparting more complex movement to objects within a card which are not limited by the drawbacks of the prior art.

SUMMARY

This summary is provided to introduce a selection of concepts in a simplified form that are further described below in the detailed description section. This summary is not intended to identify key features or essential features of the claimed subject matter, nor is it intended to be used as an aid in determining the scope of the claimed subject matter. The scope of the invention is defined by the claims.

Embodiments of the invention are directed to a movable lever and spiral lift device for providing an animated and/or "pop-up" product that may be incorporated into a greeting card, a book, or the like. The lever and spiral lift design, also referred to herein as a cam lift mechanism, allows for rotational motion and/or outward extension of two-dimensional and/or three-dimensional decorative paper or paperboard elements in a greeting card, book, or other pivotally-opened item upon opening thereof. Furthermore, the paper mechanics design of the device provides a compact product for ease of handling by the user.

Aspects described herein provide for an openable apparatus that includes a decorative portion mechanically driven by a cam lever that in turn harnesses the work input by the consumer in opening the apparatus. In one aspect, the openable apparatus takes the form of a greeting card assembly, including a card body panel having a first subpanel and a second subpanel separated by a fold, one or more cam lift mechanisms actuatable by pivoting at least one of the subpanels at the fold, and one or more decorative elements set in motion by actuation of the one or more cam lift mechanisms. The second subpanel may have one or more cam slots or openings formed therethrough. The one or more cam lift mechanisms may include a rotating portion rotatably attached to the second subpanel via a primary axle, one or more tab portions integral with or fixed to the rotating portion and extending through the cam slots, and a cam lever flexibly or rotatably attached to the rotating portion (e.g., via one or more secondary axles). The cam lever may also be fixedly attached to the first subpanel, such that opening of the card (i.e., pivoting of one of the subpanels in a direction away from another of the subpanels) rotates the one or more cam lift mechanisms about the primary axle.

The tab portions may slide from a first end of the cam slots to a second end of the cam slots upon rotation of the one or more cam lift mechanisms. This sliding is caused by opening of the card body panel that pulls the cam lever in a lateral direction (e.g., from right to left) from a first position to a second position, which in turn rotates the rotating portion about the primary axle. The cam slots may be straight or slightly curved elongated channels and may each have the first end spaced a first radial distance from the primary axle and the second end spaced a second radial distance from the primary axle. The first radial distance is greater than the second radial distance. The tab portions may attach to outer edge portions of the one or more decorative elements, thereby rotating and/or causing the decorative elements to extend outward (i.e., pop up) from the card when the card is opened. For example, the cam slots may guide the rotating tab portions inward toward the primary axle, thereby guiding portions of the decorative elements inward and causing the decorative elements to pop up or extend away from the card body panel.

Additional advantages and features of the invention will be set forth in part in a description which follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION

Figure 1:
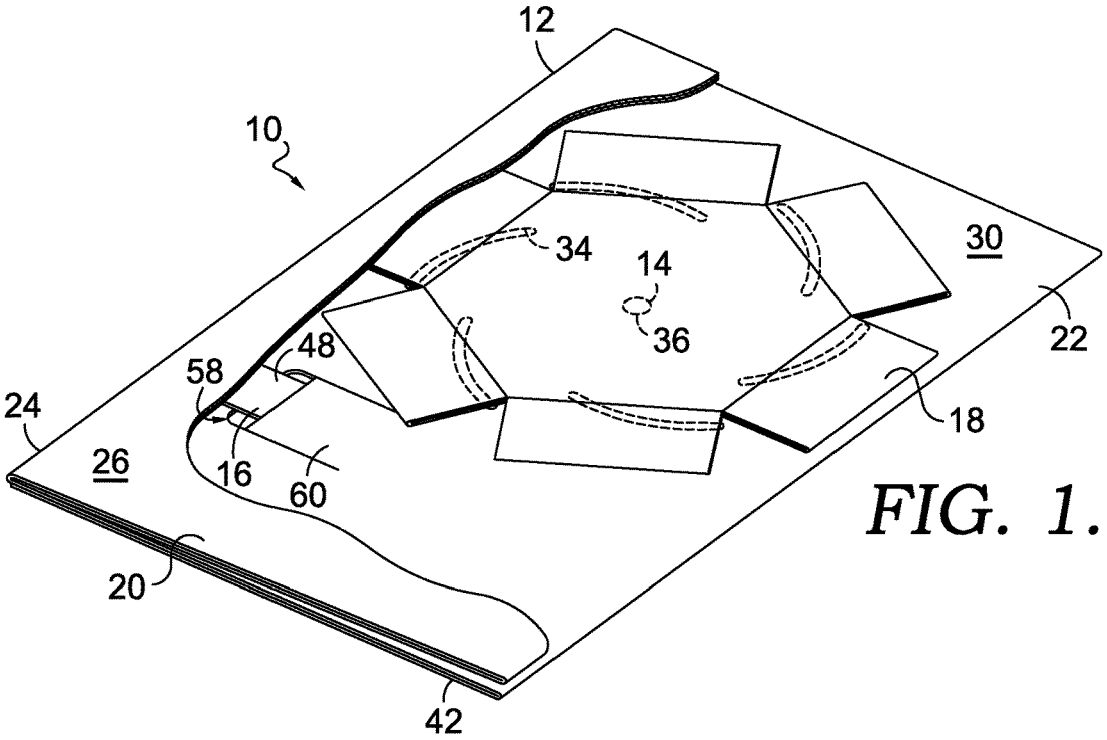
FIG. 1 is a front perspective view of a greeting card in a closed position with a portion of a first panel partially cut away to illustrate a second panel and a decorative element normally concealed therebeneath, in accordance with one embodiment of the present invention.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or a combination of steps similar to the ones described in this document, in conjunction with the other present or future technologies.

A greeting card in accordance with various embodiments described herein is shown throughout the figures. As explained more fully herein, the greeting card employs a cam lift mechanism to generate animation and outward extension of certain design elements in response to user initiated input of opening the greeting card or otherwise manually activating the cam lift mechanism. Although the cam lift mechanism is described herein as being integrated into a modified version of a traditional greeting card or similar structure, note that other similarly-openable structures (e.g., a book, a magazine, a brochure, a table decoration, or the like) can incorporate this cam lift mechanism without departing from the scope of the embodiments described herein. The decorative elements being animated or extended outward, along with other indicia positioned on the greeting card, provide a theme (e.g., birthday, anniversary, or the like) for the amusement of the user.

Referring now to the drawings in more detail and initially to FIGS. 1-14, reference numeral 10 designates one embodiment of a greeting card assembly. The greeting card assembly 10 broadly includes a card body panel 12, a primary axle 14, a cam lift mechanism 16, and a decorative element 18. The card body panel 12 may be made of paper, paperboard, cardstock, thin cardboard, or other thin and easily bendable materials and may have indicia or decorative designs printed thereon or otherwise applied thereto, such as text, drawings, paintings, glitter, pasted-on decorative features and the like. The card body panel 12 may include at least a first subpanel 20 and a second subpanel 22 separated by a fold 24. The first subpanel 20 and second subpanel 22 may pivot toward and away from each other about the fold 24. The first subpanel 20 and the second subpanel 22 may each have a top edge, a bottom edge, a first side edge, and a second side edge. The fold 24 may be formed where the first side edge of the first subpanel 20 meets the first side edge of the second subpanel 22. Furthermore, the first subpanel 20 may have a first front surface 26 and a first back surface 28. Likewise, the second subpanel 22 may have a second front surface 30 and a second back surface 32.

Figure 12:
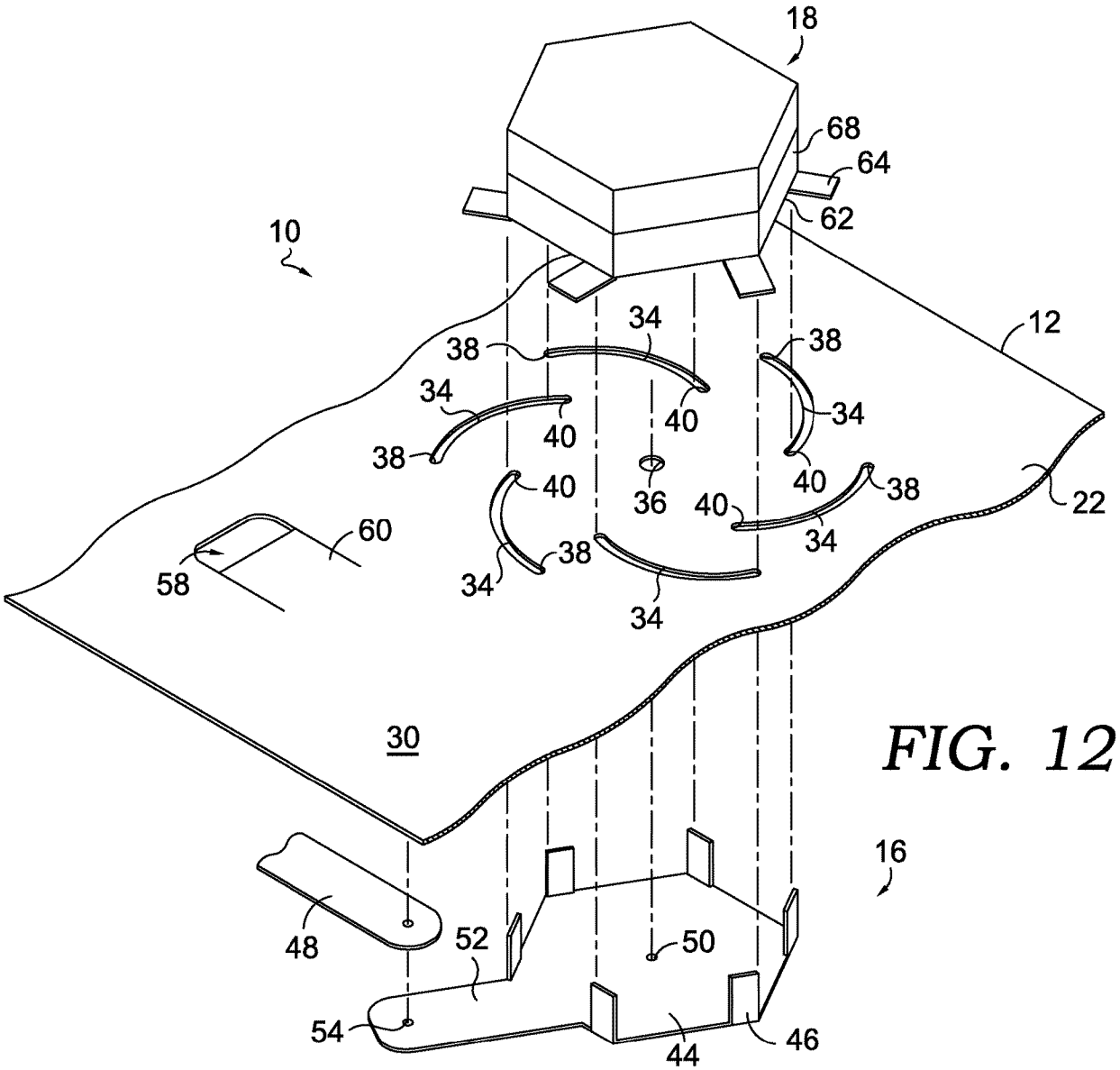
FIG. 12 is an exploded perspective view of the greeting card of FIG. 4, depicting the decorative element, the second panel, and the cam lift mechanism.

The second subpanel 22 includes one or more openings formed therethrough, generally referred to herein as cam slots 34, as illustrated in FIG. 12. The cam slots 34 may be formed around a primary axle opening 36 through which the primary axle 14 may extend, as later described herein. The cam slots 34 may be straight or curved elongated openings each having a first end 38 and a second end 40. The first end 38 may be located a first radial distance away from the primary axle 14 or primary axle opening 36 and the second end 40 may be located a second radial distance away from the primary axle 14 or primary axle opening 36. The first distance may be greater than the second distance or vice versa.

In some embodiments, the card body panel 12 may include a back cover subpanel (or a third subpanel) 42 or any number of additional subpanels configured to hide non-aesthetic portions of the greeting card assembly 10 from view. Such non-aesthetic portions may include, for example, portions of the primary axle 14 or cam lift mechanism 16. The back cover subpanel may be integrally formed with and/or fixedly attached to the second subpanel 22. For example, the back cover subpanel 42 may have a first side edge pivotally attached along a second fold line to the second side edge of the second subpanel 22. Alternatively, the back cover subpanel's first side edge may alternatively be pivotally attached to the first side edge of the first subpanel 20 and a second side edge of the back cover subpanel 42 may be pivotally attached to the first side edge of the second subpanel 22. In either embodiment, the second subpanel 22 may be attached to the back cover subpanel 42 such that when the card body panel 12 is in the closed position, the second subpanel 22 is located between the first subpanel 20 and the back cover subpanel 42.

Furthermore, when the card body panel 12 is in the open position, the second subpanel 22 may at least partially cover the back cover subpanel 42. In some embodiments, when transitioning from the closed position to the open position, the second subpanel 22 and the back cover subpanel 42 may be fixed together to cooperatively pivot away from the first subpanel 20. At least a portion of the cam lift mechanism 16 may be rotatably attached in a space between the second subpanel 22 and the back cover subpanel 42, such that the back cover subpanel 42 protects the cam lift mechanism 16 from catching on anything, such as the user's hand while they hold the card body panel 12.

Figure 2:
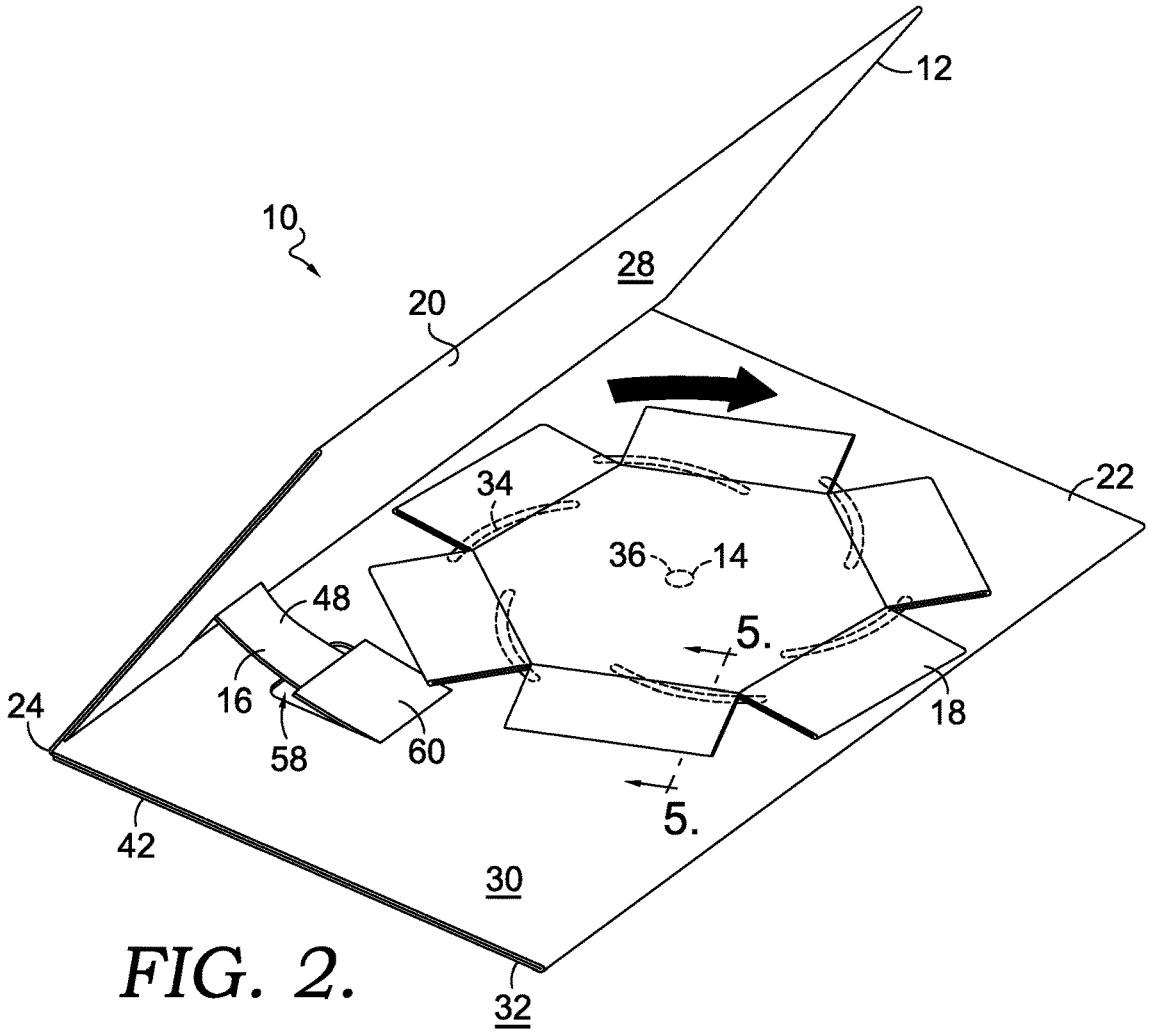
FIG. 2 is a front perspective view of the greeting card of FIG. 1, with the greeting card beginning to move from the closed position to an open position.
Figure 3:
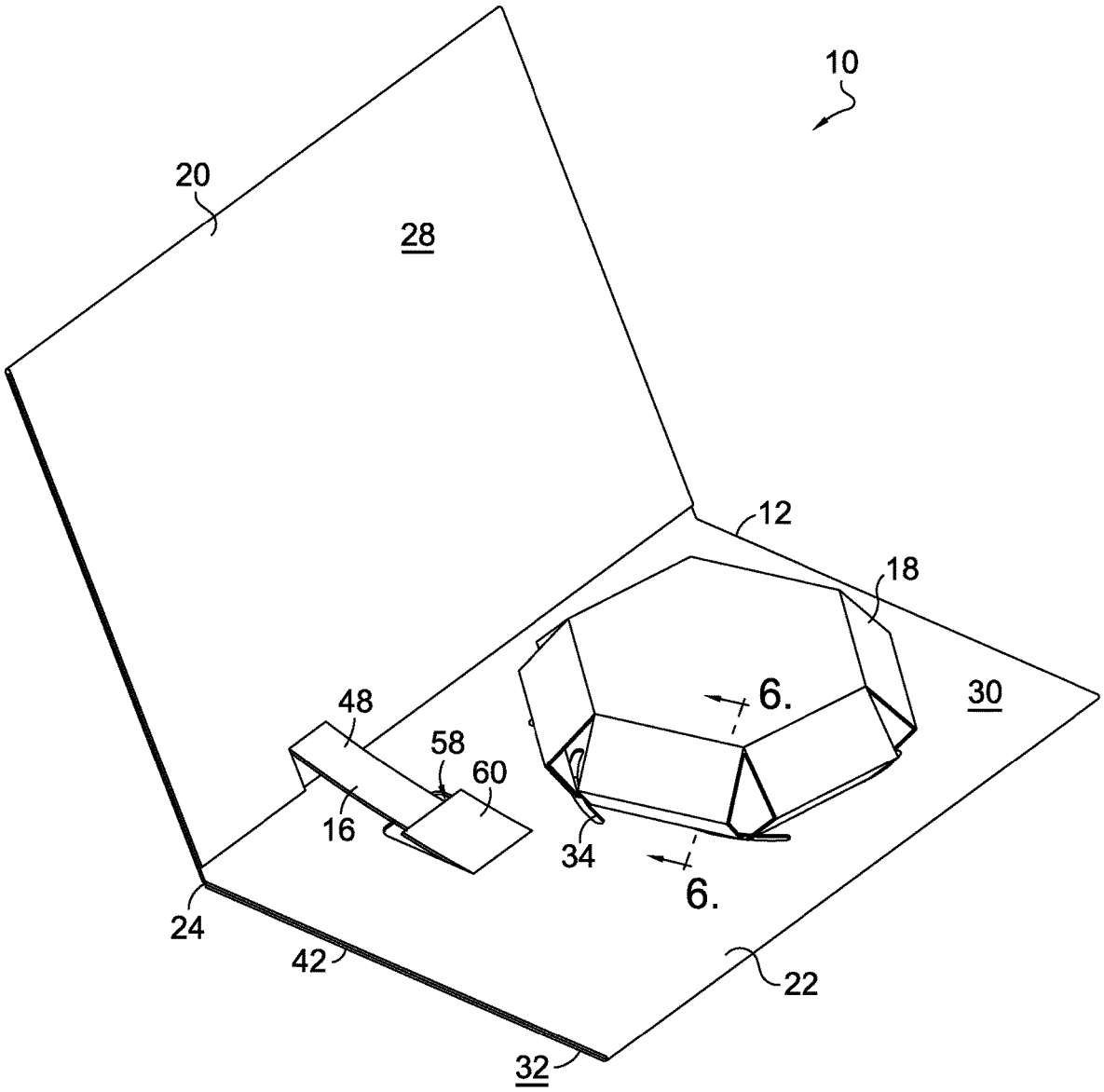
FIG. 3 is a front perspective view of the greeting card of FIG. 1, with the greeting card continuing to move toward the open position.

The primary axle 14, as depicted in FIGS. 1-2, may be any circular or cylindrical rigid component sized to fit within the primary axle opening 36 and affixed to the second subpanel 22 and/or the back cover subpanel. The primary axle 14 may also extend through an opening in the cam lift mechanism 16, as later described herein, such that the cam lift mechanism 16 may rotate about the primary axle 14. In some embodiments, the primary axle 14 may be a brad or other such fastener for allowing rotational attachment of paper components. Additionally or alternatively, the primary axle 14 may have a spindle configuration with a cylindrical portion, a head portion at one end of the cylindrical portion, and a backstop portion at an opposite end of the cylindrical portion, thereby preventing the primary axle 14 from sliding out of the second subpanel 22, the cam lift mechanism 16, and/or the back cover subpanel. Other axle configurations may be used for rotatable attachment without departing from the scope of the technology described herein.

Figure 14:
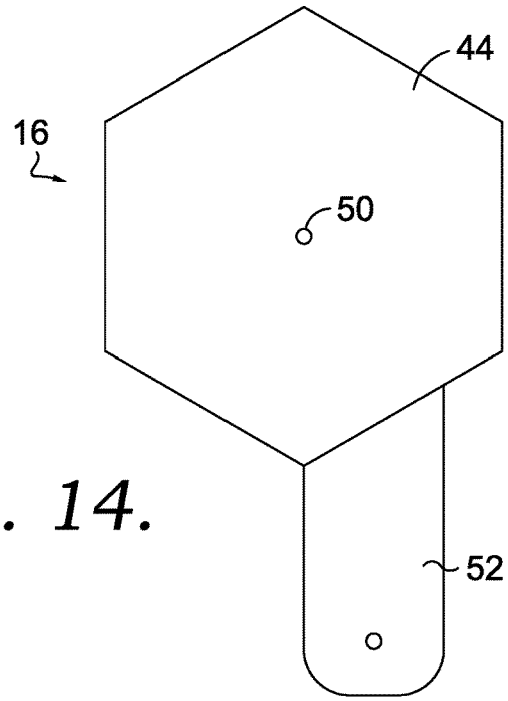
FIG. 14 is a plan view of the cam lift mechanism of FIG. 12.

The cam lift mechanism 16, as illustrated in FIGS. 12 and 14, may comprise a rotating portion 44 rotatably attached to the second subpanel 22 via the primary axle 14, one or more tab portions 46 extending through the cam slots 34 of the second subpanel 22, and a cam lever 48 attached to the rotating portion 44 and fixed to or integrally formed with the first subpanel 20. In some embodiments, the rotating portion 44 may have a first rotating portion opening 50 for the primary axle 14 to be inserted therethrough. The rotating portion 44 may have any size or shape that allows rotation thereof within outer boundaries of the card body panel 12. For example, the rotating portion 44 may be a circle, triangle, square, diamond, pentagon, hexagon, octagon, or any two-dimensional shape. The first rotating portion opening 50 may be located at a center point of the rotating portion 44 or at an off-center point of the rotating portion 44 without departing from the scope of the invention.

The rotating portion 44 may also include an extended arm portion 52 that extends or protrudes outward from a predominating geometric shape of the rotating portion 44. In one example embodiment, the extended arm portion 52 may be an elongated protruding arm integrally formed with and extending from a hexagonal segment of the rotating portion 44. The rotating portion 44 may also have a second rotating portion opening 54, formed off-center relative to the first rotating portion opening 50 and the primary axle 14. In some embodiments, the second rotating portion opening 54 may be formed through the extended arm portion 52 proximate to an end thereof, as depicted in FIG. 12. The second rotating portion opening 54 may be configured to receive a secondary axle 56 for rotatably coupling the rotating portion 44 to the cam lever 48, as depicted in FIGS. 5-8.

In some embodiments, the one or more tab portions 46 can be integral with or attached to the rotating portion 44. The tab portions 46 may extend through the cam slots 34 and can attach to the at least one decorative element 18, such that a majority of each of the tab portions 46 can be positioned between the back surface 28 of the first subpanel 20 and the front surface 30 of the second subpanel 22 when the card body panel 12 is in the closed position as in FIGS. 1 and 9. The tab portions 46 may be configured to be adhered or otherwise attached to the decorative element 18.

Figure 4:
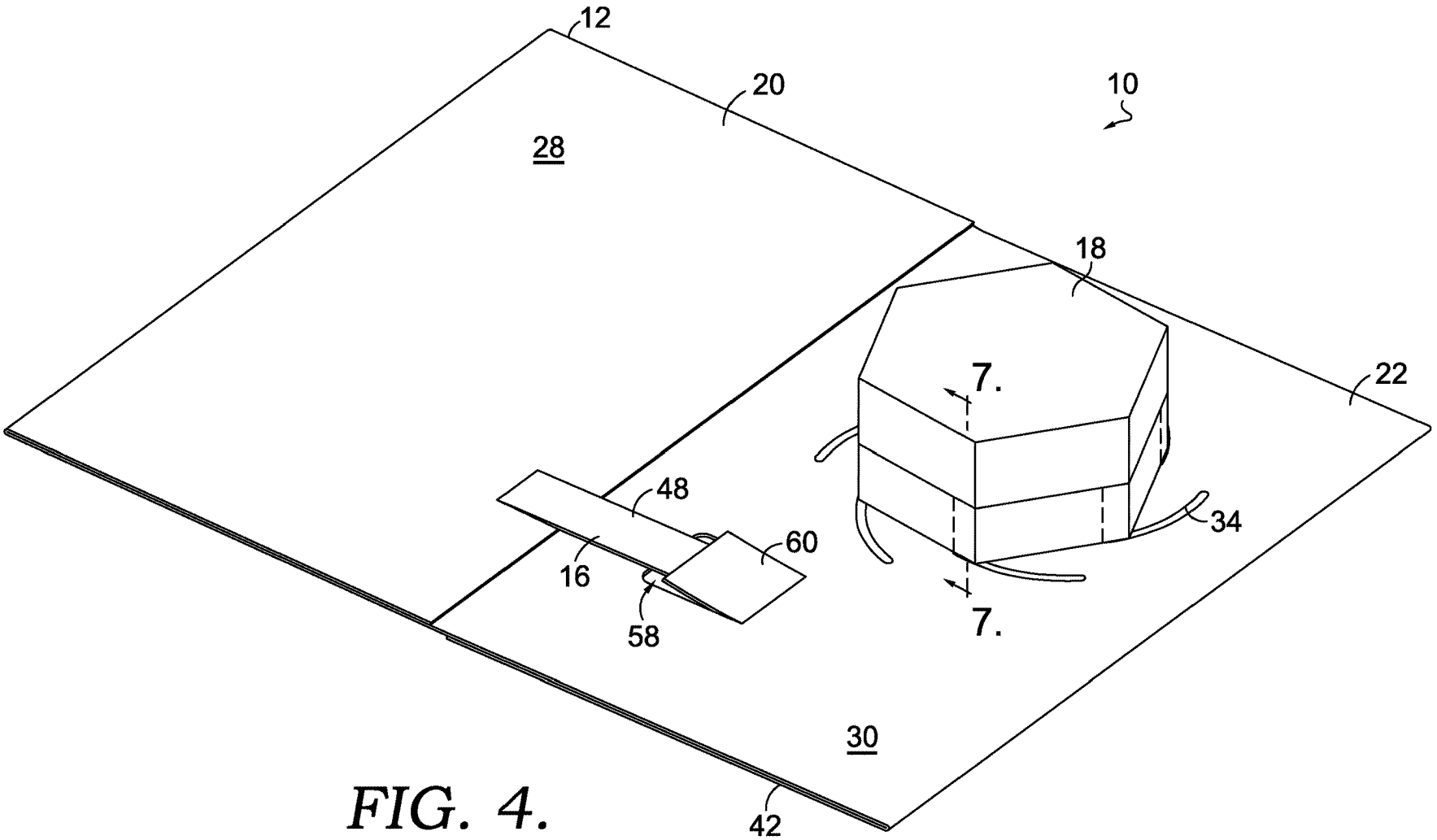
FIG. 4 is a front perspective view of the greeting card of FIG. 1, with the greeting card in the open position.
Figure 5:
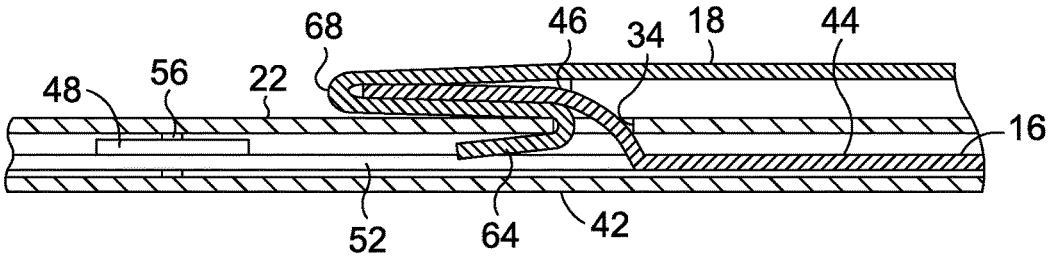
FIG. 5 is a fragmentary cross-sectional view of the greeting card and decorative element of FIG. 1, taken along line 5-5 in FIG. 2.
Figure 6:
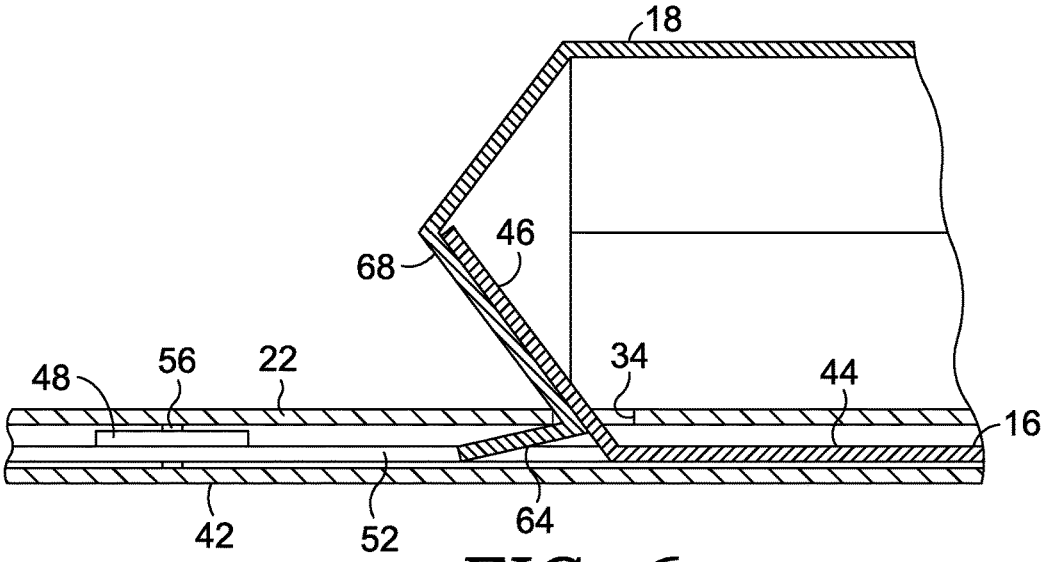
FIG. 6 is a fragmentary cross-sectional view of the greeting card and decorative element of FIG. 1, taken along line 6-6 in FIG. 3.
Figure 7:
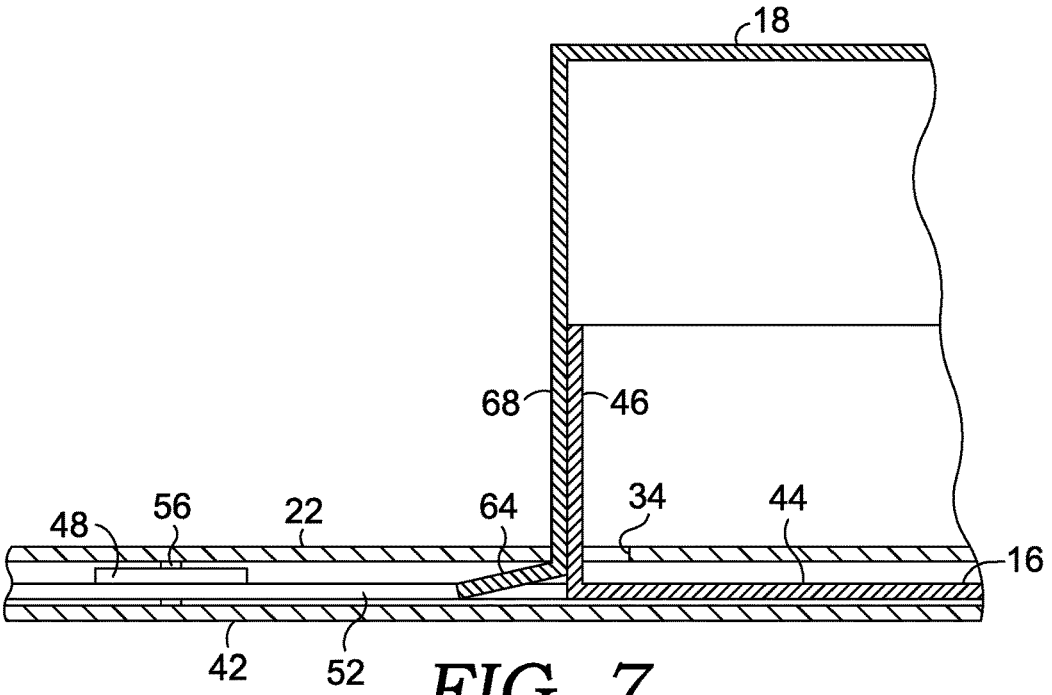
FIG. 7 is a fragmentary cross-sectional view of the greeting card and decorative element of FIG. 1, taken along line 7-7 in FIG. 4.
Figure 8:
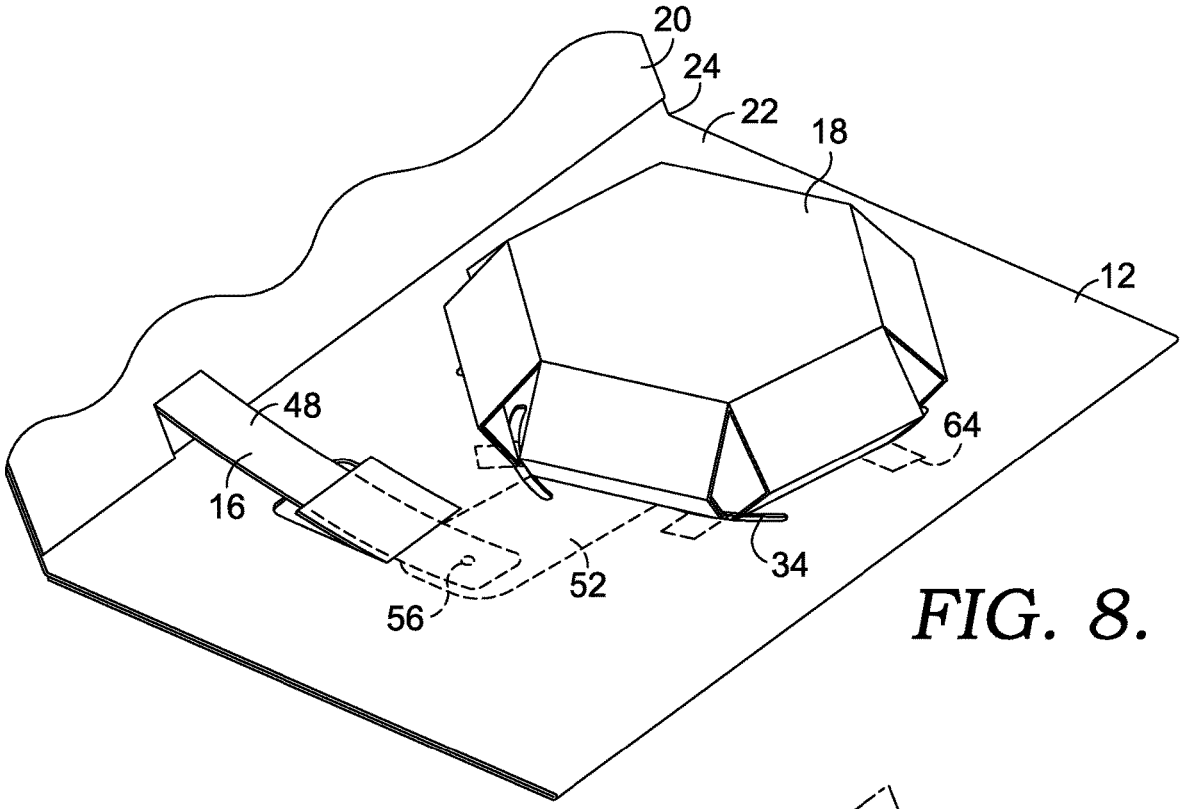
FIG. 8 is a perspective view of the greeting card of FIG. 3 with a cam lift mechanism illustrated in broken lines beneath a portion of the second panel.
Figure 9:
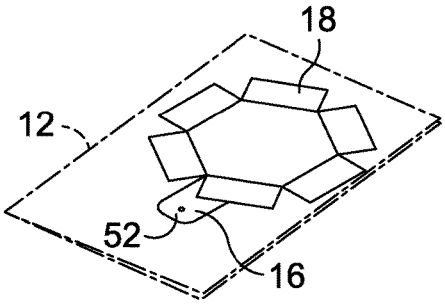
FIG. 9 is a perspective view of the decorative element and an extended arm portion of a cam lift mechanism when the greeting card of FIG. 1 is in the closed position.
Figure 10:
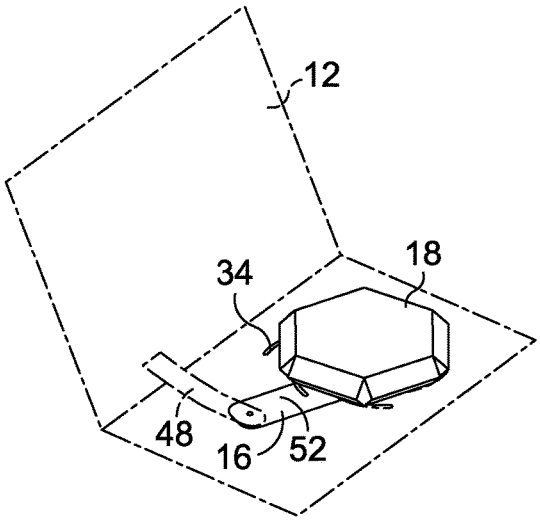
FIG. 10 is a perspective view of the decorative element and the extended arm portion of the cam lift mechanism when the greeting card of FIG. 3 is between the closed position and the open position.
Figure 11:
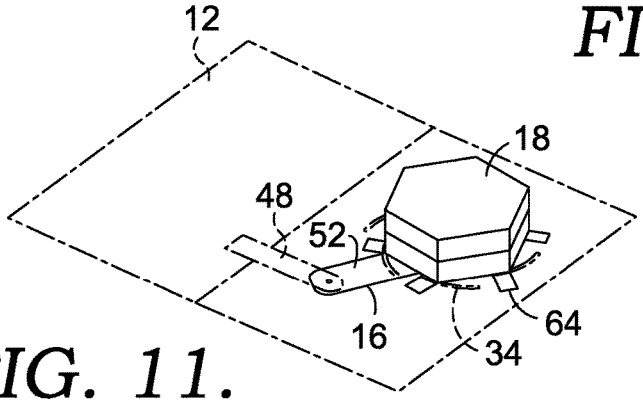
FIG. 11 is a perspective view of the decorative element and the extended arm portion of the cam lift mechanism when the greeting card of FIG. 4 is in the open position.

The cam lever 48 may be a drive shaft configured to move laterally from a first position to a second position when the first subpanel 20 is pivoted about the fold 24 in a direction away from the second subpanel 22. Specifically, the cam lever 48 may slidably extend through a cam lever opening 58 formed through the second subpanel 22. For example, the cam lever opening 58 may be slightly wider than the cam lever 48 and in some embodiments may be at least partially covered by a cam lever opening flap 60. Furthermore, the cam lever 48 may be rotatably attached to the rotating portion 44 (such as at the secondary axle 56) and integrally formed with or fixedly attach to the back surface 28 of the first subpanel 20. The cam lever 48 may slide away from the second subpanel 22 when the first subpanel 20 is pivoted away from the second subpanel 22. When the cam lever 48 moves laterally from the first position (as depicted in FIG. 1) to the second position (as depicted in FIG. 4), the rotating portion 44 is pulled from a point at which the cam lever 48 attaches to the rotating portion 44, such as at the second rotating portion opening 54 of the extended arm portion 52 via the secondary axle 56. Rotatable attachment between the cam lever 48 and the extended arm portion 52, for example, allow the extended arm portion 52 to freely pivot about the secondary axle 56 while the rotating portion 44 is pulled thereby, causing the rotating portion 44 to rotate about the primary axle 14. In some embodiments, the secondary axle 56 may be omitted and attachment between the rotating portion 44 and the cam lever 48 may merely be a fixed attachment and/or a flexible attachment. For example, the extended arm portion 52 may be integrally formed with the cam lever 48 and may be integrally joined at a folded joint that is at least partially unfolded when the cam lever 48 moves from the first position to the second position.

Figure 13:
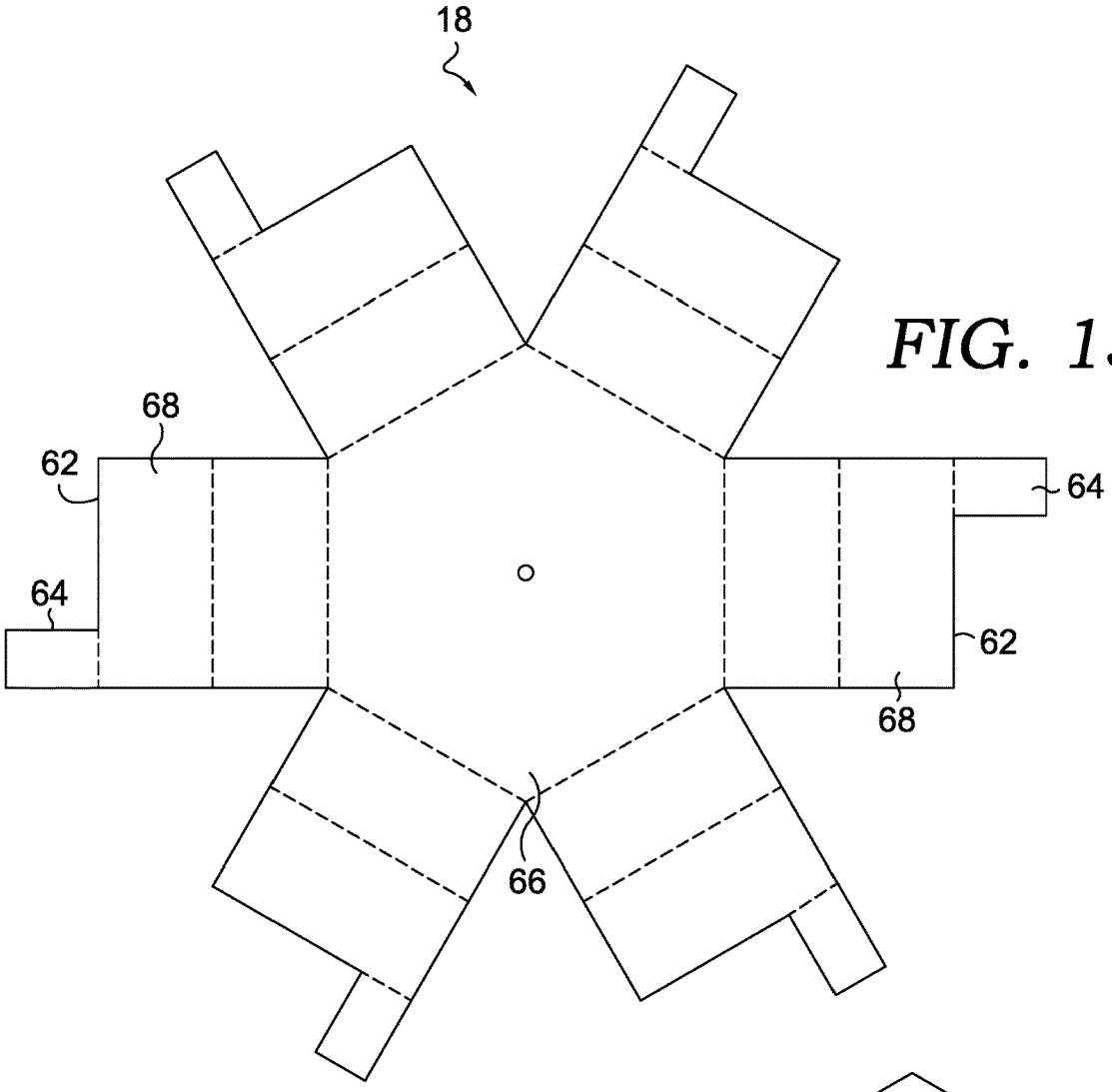
FIG. 13 is a plan view of the decorative element of FIG. 12.

As illustrated in FIG. 13, the decorative element 18 may include one or more decorative panels affixed to the one or more tab portions 46 of the cam lift mechanism 16. At least a portion of the decorative element 18 may be operable to rotate about the primary axle 14 and/or extend in a direction away from the second subpanel 22 in response to the rotating portion 44 rotating when the cam lever 48 moves from the first position to the second position. In some embodiments, the decorative element 18 is comprised of at least one decorative panel having outer edge portions 62 integral with or fixed to the one or more tab portions 46 of the cam lift mechanism 16. The decorative element 18 may also include slot-engaging tabs 64. Specifically, the slot-engaging tabs 64 can be integral with or attached to outer-most edges of the decorative panel and can extend through the cam slots 34 such that they are located adjacent the second surface 30 of the second subpanel 22. Furthermore, the slot-engaging tabs 64 can extend radially away from the primary axle 14. In some embodiments, the slot-engaging tabs 64 can be located between the second subpanel 22 and the back cover subpanel 42.

The decorative element 18 can include a decorative panel having a plurality of folds configured such that the decorative panel rests in a first folded configuration when the card body panel 12 is in the closed position and at least a portion of the decorative panel is extended in a direction away from the second subpanel 22 into a second unfolded configuration when the card body panel 12 is moved from the closed position to the open position. Specifically, this second unfolded configuration occurs due to the outer edge portions 62 of the decorative panel being pushed closer to each other and radially closer to the primary axle 14, as guided by the cam slots 34, when the rotating portion 44 is rotated by the cam lever 48 moving from the first position to the second position.

Furthermore, in some embodiments, the decorative element 18 or the decorative panel thereof may have a center portion 66 of a geometric shape such as a hexagon and each edge of the hexagon may have a flap 68 extending therefrom and integral thereto, joining at a first fold or crease with the hexagon edge. Note that the center portion 66 is merely located inward of the flaps 68 and does not require being exactly centered relative to any other component. Each of the flaps 68 may have a second fold separating a first and a second portion of the flap 68, with the first portion of the flap 68 attached to the hexagon-shaped center portion and the second portion of the flap 68 attached to one of the tab portions 46 on the cam lift mechanism 16. Thus, in the closed position of the card body panel 12, as in FIG. 1, the first and second portions of the flap 68 rest atop each other and are bent at the second fold while the first fold is extended with the first portion of the flap planar with the hexagon-shaped center portion 66. Then, in the open position of the card body panel 12, as in FIG. 4, at the first fold the first portion of the flap 68 is bent at a substantially 90-degree angle and the second fold is extended with the first portion and the second portion of the flap 68 generally planar with each other and substantially perpendicular to the second subpanel 22. Furthermore, in this open position, the flaps 68 of the decorative panel cooperatively form side walls of a three-dimensional shape.

Figure 15:
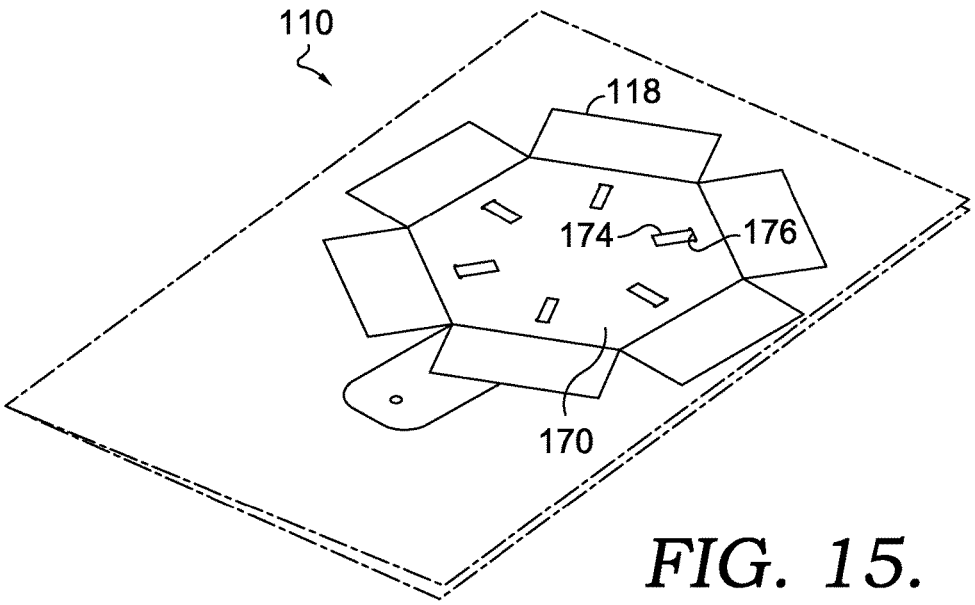
FIG. 15 is a perspective view of an alternative embodiment of a decorative element in a greeting card, with the greeting card in a closed position.
Figure 16:
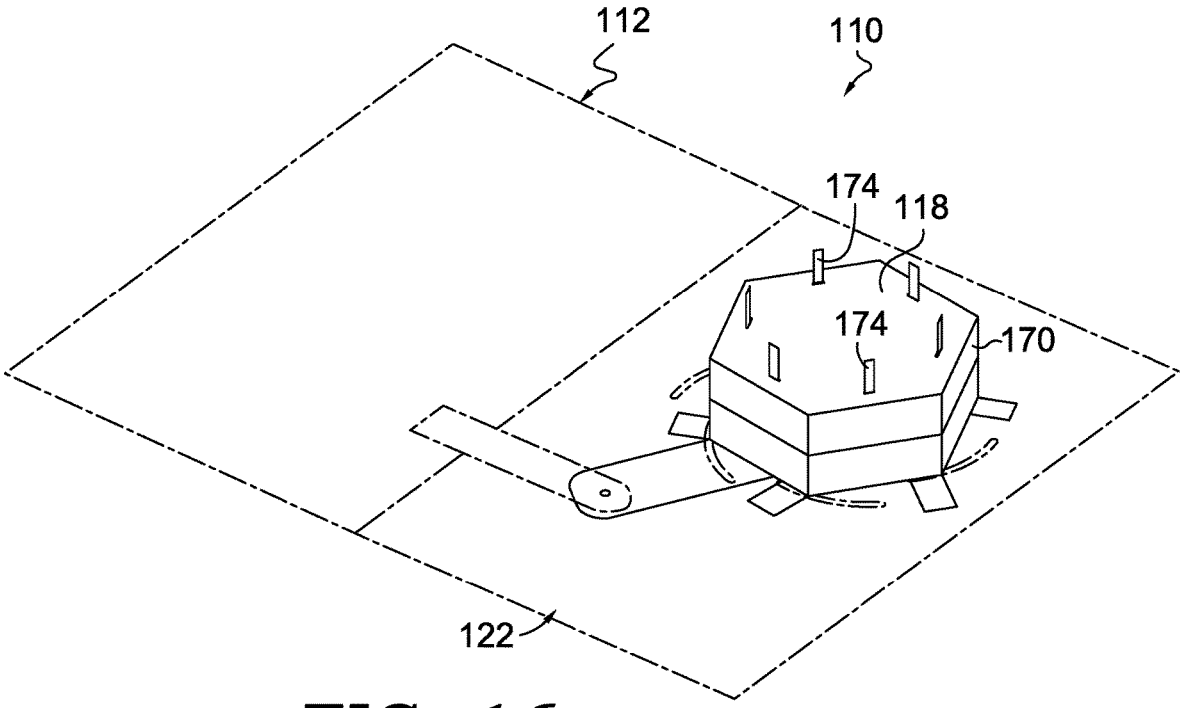
FIG. 16 is a perspective view of the decorative element of FIG. 15 in an open position.
Figure 17:
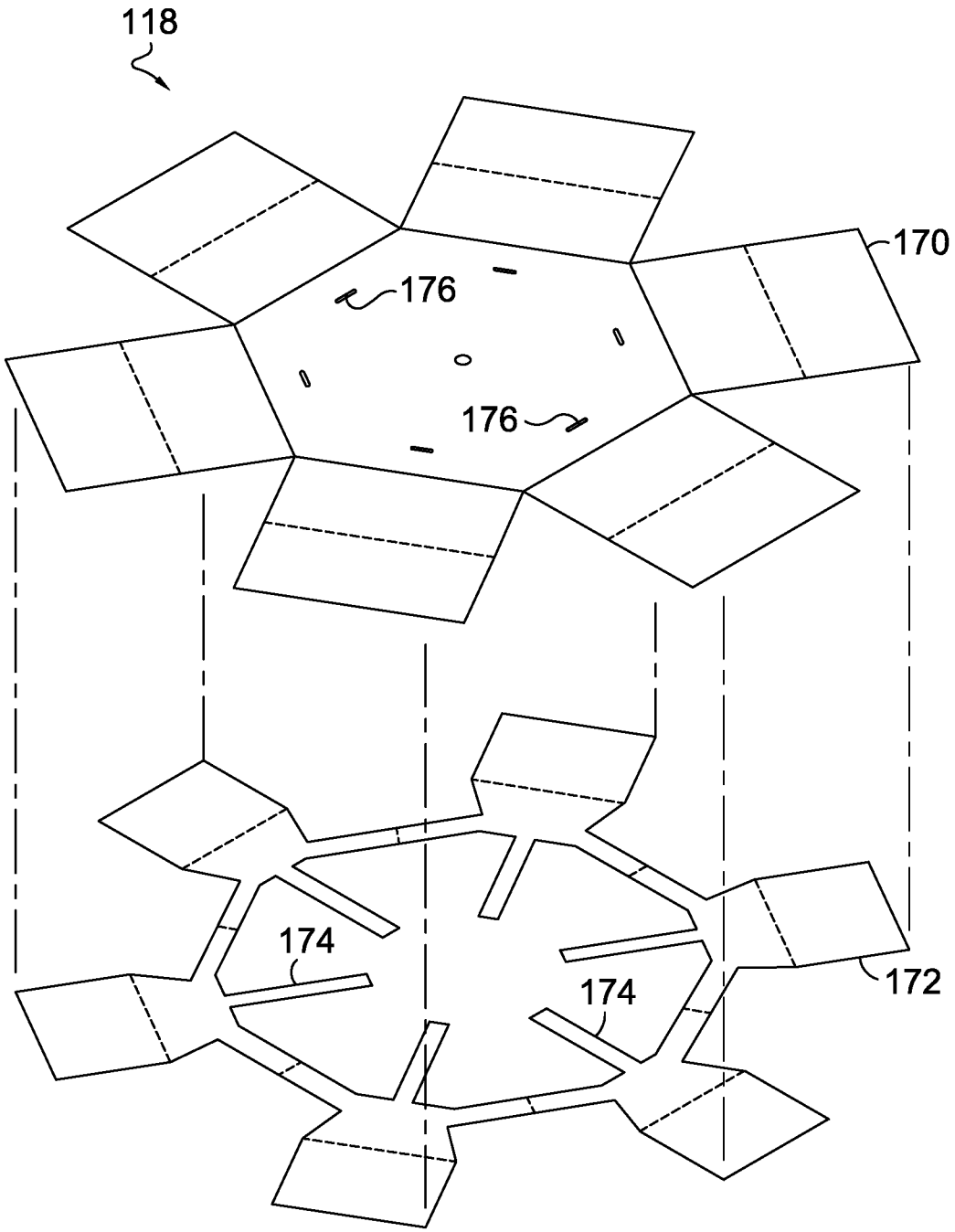
FIG. 17 is an exploded perspective view of the decorative element of FIG. 15 having a first decorative panel and a second decorative panel for engaging with slots in the first decorative panel.

As illustrated in FIGS. 15-17, in some embodiments, a greeting card assembly 110 substantially similar to the greeting card assembly 10 may alternatively include a decorative element 118 comprising a first decorative panel 170 and a second decorative panel 172. The first decorative panel 170 may be substantially similar to the decorative panel depicted in FIGS. 1-14, while the second decorative panel 172 may be located under the first decorative panel 170 and may have extension portions 174 that extend through one or more holes or slots 176 in the first decorative panel 170. The second decorative panel 172 may also have flaps similar to the first decorative panel 170 that attach to the first decorative panel's flaps in such a way as to push the flaps of the second decorative panel 172 inward to extend the extension portions 174 upward, as described herein. Specifically, when a card body panel 112 of the greeting card assembly 110 is in a closed position, as in FIG. 15, the extension portions 174 extending through the one or more holes or slots 176 in the first decorative panel 170 are folded inward toward each other atop the first decorative panel 170. Then, in an open position as in FIG. 16, the extension portions 174 extending through the one or more holes or slots 176 in the first decorative panel 170 are extended upward or outward from the first decorative panel 170 that is also extending outward from a second subpanel 122 of the card body panel 112. So, for example, as illustrated in FIG. 16, the first decorative panel 170 forms a three-dimensional hexagon to mimic a cake and the extension portions 174 of the second decorative panel 172 visually mimic candles on the cake. Other such designs using two decorative panels and an extension portion may operate in a similar manner without departing from the scope of the technology described herein.

Figure 18:
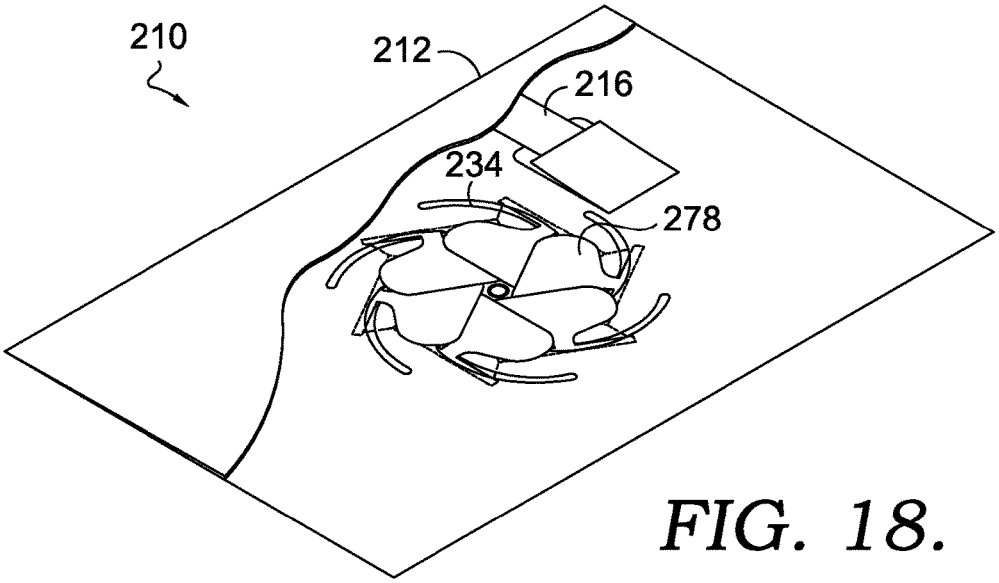
FIG. 18 is a perspective view of another alternative embodiment of a decorative element in a greeting card, with the greeting card in a closed configuration.
Figure 19:
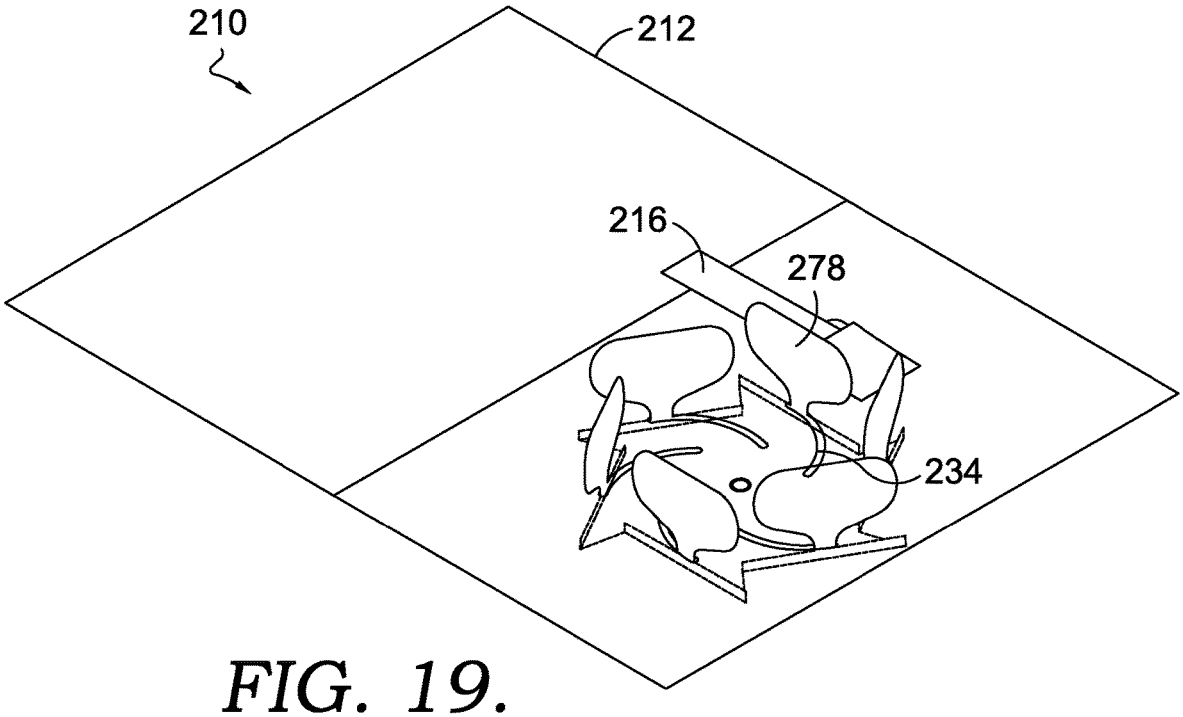
FIG. 19 is a perspective view of the decorative element of FIG. 18 when the greeting card is in an open position.
Figure 20:
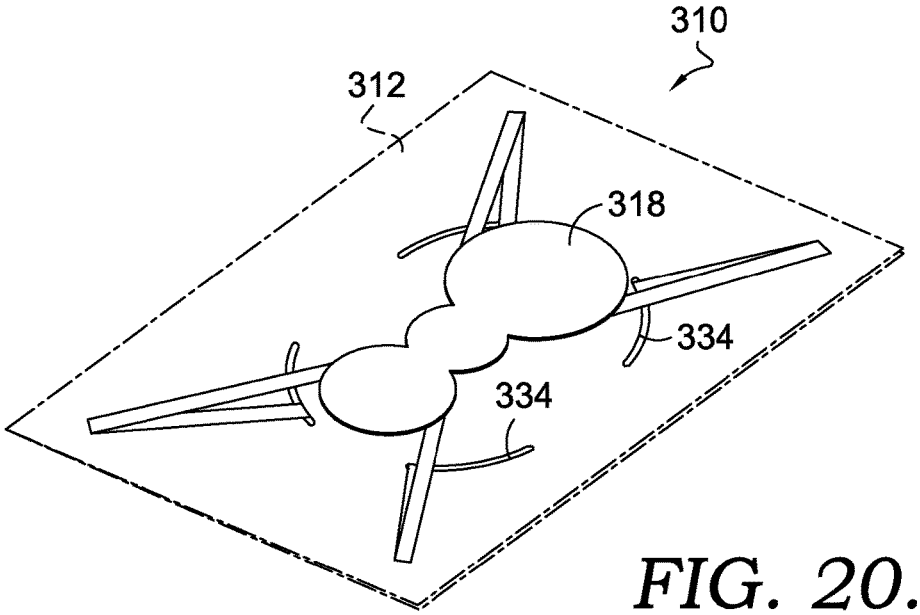
FIG. 20 is a perspective view of yet another alternative embodiment of a decorative element in a greeting card, with the greeting card in a closed position.
Figure 21:
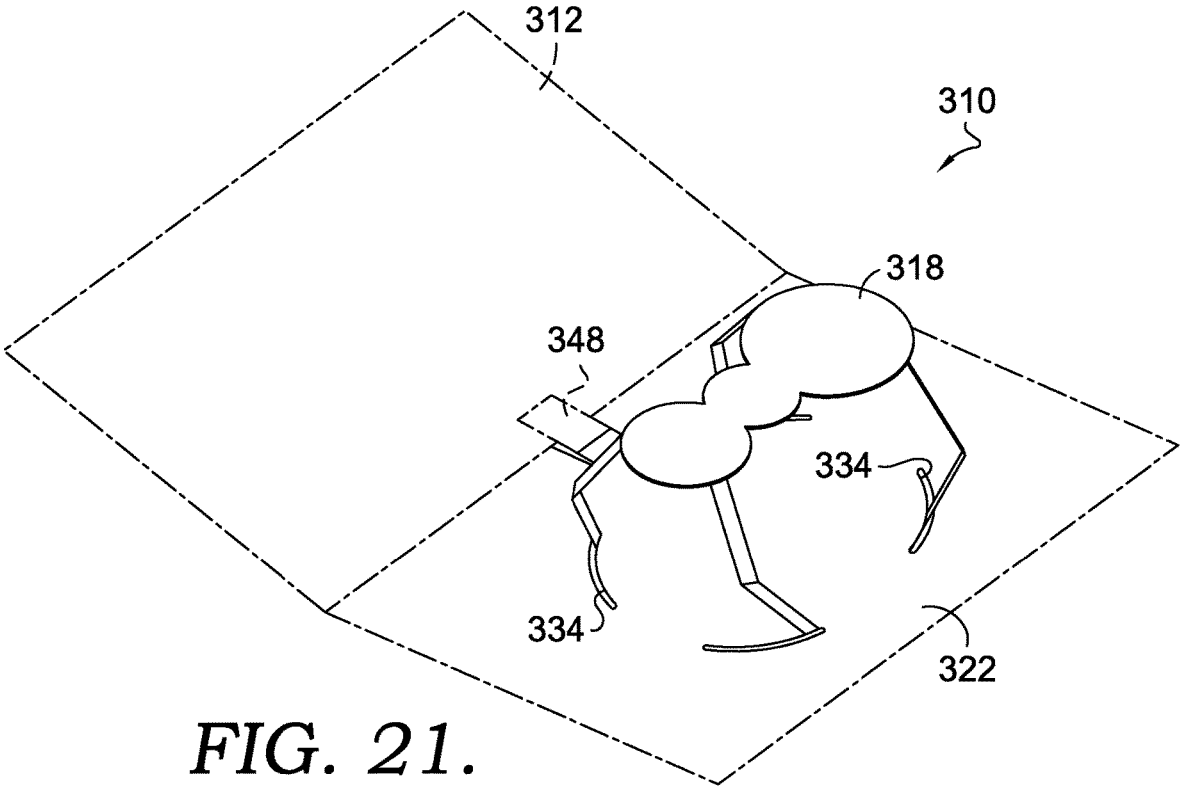
FIG. 21 is a perspective view of the decorative element of FIG. 20 when the greeting card is in an open position.
Figure 22:
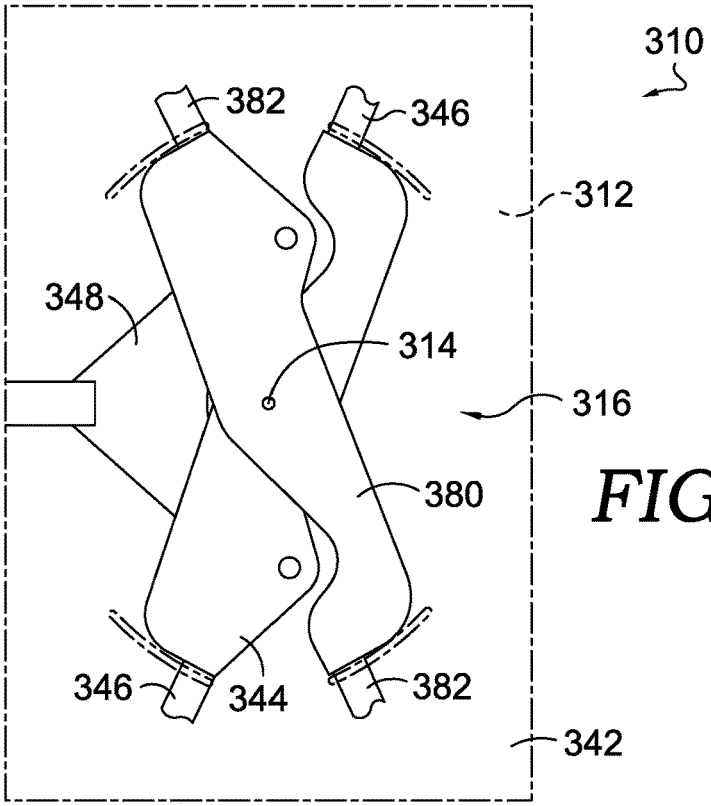
FIG. 22 is a perspective view of an alternate embodiment of a cam lift mechanism for use with and attached to the decorative element of FIG. 20 when the greeting card is in the closed position.
Figure 23:
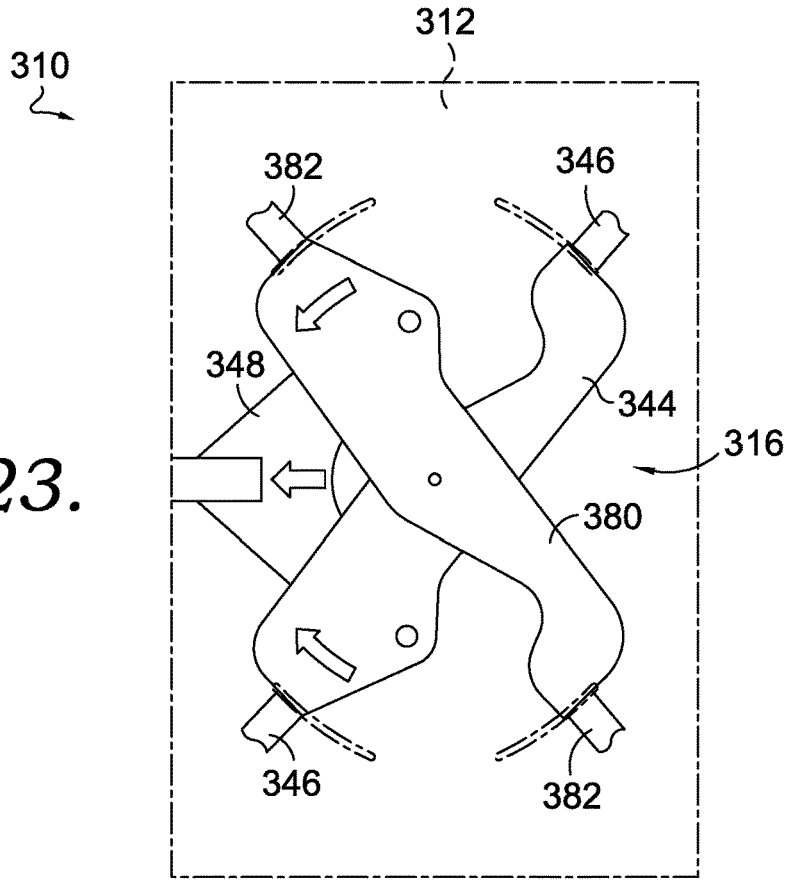
FIG. 23 is a perspective view of the alternate cam lift mechanism of FIG. 22 attached to the decorative element of FIG. 21 when the greeting card is in the open position.

In some embodiments, for example as illustrated in FIGS. 18-19, a greeting card assembly 210 substantially similar to the greeting card assembly 10 may alternatively have a decorative element 218 comprised of a plurality of decorative flaps 278 each attached to or integrally formed with one of a plurality of tab portions of a cam lift mechanism 216 extending through cam slots 234. The decorative flaps 278 at least partially overlap each other when a card body panel 212 is in a closed position (as in FIG. 18) and pivot away from each other when the card body panel 212 transitions from the closed position to an open position (as in FIG. 19). For example, the decorative element 218 may be comprised of the decorative flaps 278 each representing a flower petal, such that the rotating and extending of each of the decorative flaps 278 via the cam lift mechanism 216 creates the appearance of a flower blooming.

In some embodiments, for example as illustrated in FIGS. 20-23, a greeting card assembly 310, substantially similar to the greeting card assembly 10, has a card body panel 312 and a cam lift mechanism 316 with tab portions 346 and a first rotating portion 344 having a similar design and configuration to the rotating portion 44 described above. However, the greeting card assembly 310 can additionally include a second rotating portion 380 rotatably attached to the first rotating portion 344 via a primary axle 314. The primary axle may also be attached to a second subpanel 322 and/or a back cover subpanel (or a third subpanel) 342. The second rotating portion 380 can also include one or more secondary tab portions 382 extending through cam slots 334 of the second subpanel 322, similar to the tab portions 346 attached to the first rotating portion 344.

In this embodiment, a cam lever 348 or yoke is provided that is pivotally coupled to both the first rotating portion 344 and the second rotating portion 380. As such, movement of the cam lever 348 from a first position (as in FIGS. 20 and 22) to a second position (as in FIGS. 21 and 23) rotates the second rotating portion 380 in an rotational direction opposite than the first rotating portion 344. Alternatively, two separate cam levers (not shown) substantially similar to the cam lever 48, each connected to one of the first and second rotating portions 344, 380, may be used to separately actuate the first and second rotating portions 344, 380. The location where the cam lever 348 or the multiple cam levers attach to the first rotating portion 344 and/or the second rotating portion 380 determines which way the first rotating portion 344 and the second rotating portion 380 rotate, either in the same rotational direction as each other or in opposite rotational directions. Furthermore, any quantity of additional rotating portions and cam levers constructed as described herein may be added to the greeting card assembly 10 without departing from the scope of this technology.

As can be appreciated, the various embodiments of the greeting card assembly and its various components can provide numerous combinations of decorative elements and three-dimensional pop-up designs activated via rotation of portions of the decorative elements radially inward or radially outward. Other embodiments of and modifications to the invention are beneficial as well and are within the scope of the present invention. For example, the movement of the components can be used to produce mechanical or electronic sounds.

In some alternative embodiments, the first subpanel 20 of the card body panel 12 may be omitted and the cam lever 48 may be laterally moved from the first position to the second position manually by a user pulling the cam lever 48 or a tab attached to the cam lever 48. Additionally or alternatively, the second subpanel 22 may serve as a front cover of the card body panel 12, placing the cam lift mechanism 16 and the decorative element 18 on the outside of the greeting card assembly 10, with or without a secondary cam lift mechanism inside the greeting card assembly 10. Furthermore, although the technology herein is described in reference to a greeting card, other openable items may incorporate the cam lift mechanism and the decorative element described herein without departing from the scope of this technology. Specifically, the cam lift mechanism 16 allows for rotational motion and/or pop-up extension of two-dimensional and/or three-dimensional decorative paper, cardstock, paperboard, thin cardboard, plastic or the like elements in a greeting card, book, or other pivotally-opened item upon opening thereof. Additionally, the greeting card assembly 10 may also be comprised of other greeting card technology known in the art, such as audio and/or light components (not shown) that turn on when the card body panel 12 is transitioned to the open position and turn off when the card body panel 12 is transitioned back to the closed position. Such technology may be powered by a battery and may be operated by a flexible drive shaft that is fixed to the first subpanel and actuates an on-off switch or circuitry or connects and disconnects an electrical component thereof.

The paper mechanics design of the greeting card assembly 10 allows for rotation and three-dimensional paper pop-up decorative elements while maintaining a thin profile desired for greeting cards and the like. Thus, the greeting card assembly 10 provides a compact product for ease of handling by the user. Furthermore, the greeting card assembly 10 provides a pop-up decorative element that is more stable upon opening compared to prior art designs, due to its ability to move multiple points on the decorative element inward or outward simultaneously to create three-dimensional pop up decorative features, such as a rectangular or square box or a hexagon-shaped birthday cake design.

Various modifications and changes from the illustrated embodiments are within the scope of the present invention. For example, while the described embodiments were illustrated with the card body formed from a single piece of cardstock folded into four subpanels, with the first two subpanels folded and secured together to create the front panel of the card and the last two subpanels folded and secured together to create the back panel of the card, other combinations and configurations can be used.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A greeting card having mechanically actuated moving portions, the greeting card comprising:

a card body panel having at least a first subpanel and a second subpanel, the first subpanel and the second subpanel being separated by a fold in the card body panel, the second subpanel having one or more openings formed therein;

a primary axle coupled with the card body panel;

a cam lift mechanism coupled with the card body panel and comprising:

a rotating portion rotatably coupled with the card body panel via the primary axle, one or more tab portions extending through the one or more openings of the second subpanel, and a cam lever attached to the rotating portion and coupled with the first subpanel, wherein the cam lever moves laterally from a first position to a second position when the first subpanel is pivoted about the fold in a rotational direction away from the second subpanel; and at least one decorative element affixed to the one or more tab portions of the cam lift mechanism, wherein at least a portion of the at least one decorative element is operable to at least one of rotate about the primary axle and extend away from the second subpanel in response to the rotating portion rotating when the cam lever moves from the first position to the second position.

2. The greeting card of claim 1, wherein the card body panel has a closed position and an open position, wherein each of the first subpanel and the second subpanel have a front surface and a back surface opposite the front surface, wherein the back surface of the first subpanel rests adjacent or against the at least one decorative element and the front surface of the second subpanel in the closed position and wherein the first subpanel pivots away from the second subpanel about the fold of the card body panel to transition from the closed position to the open position.

3. The greeting card of claim 2, wherein each of the one or more openings are elongated slots that have a first end and a second end at a different radial distance away from the primary axle than the first end, wherein the elongated slots guide the tab portions radially toward or radially away from the primary axle when the rotating portion of the cam lift mechanism rotates.

4. The greeting card of claim 3, wherein the at least one decorative element is comprised of at least one decorative panel having outer edge portions integral with or fixed to the one or more tab portions, wherein the decorative panel rests in a first folded configuration when the card body panel is in the closed position and at least a portion of the at least one decorative panel is extended away from the second subpanel into a second unfolded configuration when the card body panel is moved from the closed position to the open position due to the outer edge portions of the at least one decorative panel being pushed closer to each other and radially closer to the primary axle as guided by the elongated slots when the rotating portion is rotated by the cam lever moving from the first position to the second position.

5. The greeting card of claim 3, wherein the at least one decorative element is comprised of a plurality of decorative flaps attached to or integrally formed with the one or more tab portions, wherein the decorative flaps at least partially overlap each other when the card body panel is in the closed position and pivot away from each other when the card body panel transitions from the closed position to the open position.

6. The greeting card of claim 1, further comprising a back cover subpanel, wherein the rotating portion of the cam lift mechanism is located between the back cover subpanel and the second subpanel.

7. The greeting card of claim 1, further comprising at least one secondary axle rotatably coupling the cam lever to the rotating portion.

8. The greeting card of claim 1, wherein the one or more openings in the second subpanel include a cam lever opening through which the cam lever slides toward and away from the second subpanel when the first subpanel is pivoted away from the second subpanel.

9. The greeting card of claim 1, further comprising a second rotating portion rotatably coupled with the card body panel via the primary axle, as well as one or more secondary tab portions extending through the one or more openings of the second subpanel, wherein the second rotating portion is also attached to the cam lever such that movement of the cam lever from the first position to the second position rotates the second rotating portion in a rotational direction opposite than the rotating portion.

10. The greeting card of claim 9, wherein the cam lever is pivotally attached to the rotating portion at a first location above the primary axle, wherein the cam lever is pivotally attached to the second rotating portion at a second location below the primary axle.

11. A greeting card having mechanically actuated moving portions, the greeting card comprising:

a card body panel having at least a first subpanel and a second subpanel, the first subpanel and the second subpanel being separated by a fold in the card body panel, wherein the card body panel has a closed position and an open position, wherein each of the first subpanel and the second subpanel have a front surface and a back surface opposite the front surface, wherein the back surface of the first subpanel faces the front surface of the second subpanel in the closed position and wherein the first subpanel pivots away from the second subpanel about the fold of the card body panel to transition from the closed position to the open position, wherein the second subpanel has one or more openings formed therein, wherein each of the one or more openings are each elongated slots have a first end and a second end;

a primary axle coupled with the card body panel, wherein the first end of each of the elongated slots is a first radial distance away from the primary axle and the second end of each of the elongated slots is a second radial distance away from the primary axle, wherein the first radial distance is greater than the second radial distance;

a cam lift mechanism coupled with the card body panel comprising:

a rotating portion rotatably attached to the second subpanel via the primary axle, one or more tab portions extending through the one or more openings of the second subpanel, a cam lever pivotally attached to the rotating portion and coupled with the first subpanel, wherein the cam lever moves laterally from a first position to a second position when the first subpanel is pivoted about the fold in a rotational direction away from the second subpanel from the closed position to the open position, and at least one second axle pivotally coupling the cam lever to the rotating portion; and at least one decorative element affixed to the one or more tab portions of the cam lift mechanism, wherein at least a portion of the at least one decorative element is operable to at least one of rotate about the primary axle and extend away from the second subpanel in response to the rotating portion rotating when the cam lever moves from the first position to the second position.

12. The greeting card of claim 11, wherein the at least one decorative element is comprised of at least one decorative panel having outer edge portions integral with or fixed to the one or more tab portions, wherein the at least one decorative panel rests in a first folded configuration when the card body panel is in the closed position and at least a portion of the at least one decorative panel is extended in a direction away from the second subpanel into a second unfolded configuration when the card body panel is moved from the closed position to the open position due to the outer edge portions of the at least one decorative panel being pushed closer to each other and radially closer to the primary axle as guided by the elongated slots when the rotating portion is rotated by the cam lever moving from the first position to the second position.

13. The greeting card of claim 11, wherein the at least one decorative element is comprised of a plurality of decorative flaps each attached to or integrally formed with one of the one or more tab portions, wherein the decorative flaps at least partially overlap each other when the card body panel is in the closed position and pivot away from each other when the card body panel transitions from the closed position to the open position.

14. The greeting card of claim 11, further comprising a back cover subpanel, wherein the rotating portion of the cam lift mechanism is located between the back cover subpanel and the second subpanel, wherein the at least one decorative element comprises slot-engaging tabs extending through the one or more openings of the second subpanel and resting between the back cover subpanel and the second subpanel.

15. The greeting card of claim 11, wherein the one or more openings in the second subpanel include a cam lever opening through which the cam lever slides toward and away from the second subpanel when the first subpanel is pivoted away from the second subpanel.

16. The greeting card of claim 11, further comprising a second rotating portion rotatably attached to the second subpanel via the primary axle, as well as one or more secondary tab portions extending through the one or more openings of the second subpanel, wherein the second rotating portion is also attached to the cam lever such that movement of the cam lever from the first position to the second position rotates the second rotating portion in an opposite rotational direction than the rotating portion.

17. The greeting card of claim 16, wherein the cam lever is rotatably attached to the rotating portion at a first location above the primary axle, and wherein the cam lever is rotatably attached to the second rotating portion at a second location below the primary axle.

18. A greeting card having mechanically actuated moving portions, the greeting card comprising:

a card body panel having at least a first subpanel and a second subpanel, the first subpanel and the second subpanel being separated by a fold in the card body panel, wherein the card body panel has a closed position and an open position, wherein each of the first subpanel and the second subpanel have a front surface and a back surface opposite the front surface, wherein the back surface of the first subpanel faces the front surface of the second subpanel in the closed position and wherein the first subpanel pivots away from the second subpanel about the fold of the card body panel to transition from the closed position to the open position, wherein the second subpanel has one or more openings formed therein, wherein each of the one or more openings are each curved elongated slots have a first end and a second end;

a primary axle, wherein the first end of each of the curved elongated slots is a first radial distance away from the primary axle and the second end of each of the curved elongated slots is a second radial distance away from the primary axle, wherein the first radial distance is greater than the second radial distance;

a cam lift mechanism comprising:

a rotating portion rotatably attached to the second subpanel via the primary axle, one or more tab portions extending through the one or more openings of the second subpanel, a cam lever rotatably attached to the rotating portion and fixed to the first subpanel, wherein the cam lever moves laterally from a first position to a second position when the first subpanel is pivoted about the fold in a rotational direction away from the second subpanel from the closed position to the open position, wherein the one or more openings in the second subpanel include a cam lever opening through which the cam lever slides toward and away from the second subpanel when moving laterally to and from the first position and the second position, and at least one secondary axle rotatably coupling the cam lever to the rotating portion; and at least one decorative element affixed to the one or more tab portions of the cam lift mechanism, wherein at least a portion of the at least one decorative element is operable to at least one of rotate about the primary axle and extend away from the second subpanel in response to the rotating portion rotating when the cam lever moves from the first position to the second position, wherein the at least one decorative element is comprised of at least one decorative panel having outer edge portions integral with or fixed to the one or more tab portions, wherein the decorative panel rests in a first folded configuration when the card body panel is in the closed position and at least a portion of the at least one decorative panel is extended away from the second subpanel into a second unfolded configuration when the card body panel is moved from the closed position to the open position due to the outer edge portions of the at least one decorative panel being pushed closer to each other and radially closer to the primary axle as guided by the curved elongated slots when the rotating portion is rotated by the cam lever moving from the first position to the second position.

19. The greeting card of claim 18, further comprising a back cover subpanel, wherein the rotating portion of the cam lift mechanism is located between the back cover subpanel and the second subpanel, wherein the at least one decorative element comprises slot-engaging tabs extending through the one or more openings of the second subpanel and resting between the back cover subpanel and the second subpanel.

20. The greeting card of claim 18, wherein the card body panel, the at least one decorative element, the rotating portion, the one or more tab portions, and the cam lever are made of at least one of paper, cardstock, paperboard, cardboard, bendable plastic, and bendable metal.

* * * * *